US005526547A

United States Patent [19]

Williams et al.

[11] Patent Number: 5,526,547

[45] Date of Patent: Jun. 18, 1996

[54] WET AND DRY VACUUM CLEANER

[75] Inventors: William H. Williams, 4938 Golden Arrow Dr., Rancho Palos Verdes, Calif. 90274; Paul G. Jacobs, 9958 Amestoy Ave., Northridge, Calif. 91325

[73] Assignees: William H. Williams, Rancho Palos Verdes; Paul G. Jacobs, Northridge, both of Calif.

[21] Appl. No.: 318,460

[22] Filed: Oct. 3, 1994

[51] Int. Cl.[6] ..... A47L 7/00

[52] U.S. Cl. ..... 15/320; 15/353

[58] Field of Search ..... 15/320, 321, 327.1, 15/327.2, 353; 220/402; 222/105, 183

[56] References Cited

U.S. PATENT DOCUMENTS

| | | | |
|---|---|---|---|
| 3,040,363 | 6/1962 | Krammes et al. | 15/320 |
| 3,896,520 | 7/1975 | Williams | 15/320 |
| 3,942,217 | 3/1976 | Bates | 15/321 |
| 4,267,617 | 5/1981 | Brown et al. | 15/320 |
| 4,934,017 | 6/1990 | Kent | 15/321 |
| 4,956,891 | 9/1990 | Wulff | 15/321 |
| 5,021,095 | 6/1991 | Tamaki | 15/321 |
| 5,072,857 | 12/1991 | Coleman | 222/105 |
| 5,392,958 | 2/1995 | Kurtzahn et al. | 222/105 |

FOREIGN PATENT DOCUMENTS

| | | | |
|---|---|---|---|
| 2229417 | 9/1990 | United Kingdom | 222/105 |

*Primary Examiner*—David Scherbel
*Assistant Examiner*—Terrence R. Till
*Attorney, Agent, or Firm*—Joseph E. Mueth

[57] ABSTRACT

A floor cleaner having a rigid vacuum-retaining outer case, which is adapted to serve as a liquid reservoir, a flaccid container within the case, means for creating vacuum within the case in and around the flaccid container including an inlet communicating with the case, means communicating with the liquid reservoir for discharging liquid on a surface to be cleaned, and means communicating with the flaccid container for drawing the liquid and included dirt from the surface to be cleaned into the container under the influence of vacuum whereby the flaccid container can fill and expand with used liquid at a volume rate essentially equal to the rate of depletion of the unused liquid, within the same space of the outer rigid reservoir.

4 Claims, 7 Drawing Sheets

WET AND DRY VACUUM CLEANER

BACKGROUND OF THE INVENTION

Various floor cleaning machines are known which apply the principle of a flexible bladder or membrane to reduce the overall size and weight of the cleaning machine by using the same tank space twice with the use of a flexible and movable inner container.

U.S. Pat. No. 3,896,520 discloses a vacuum cleaner which includes a rigid vacuum-retaining outer case which acts as a clean liquid reservoir, a flaccid spent liquid-retaining container within the case, a vacuum motor for creating vacuum within the case around the flaccid container including an inlet communicating with said case. The device has means communicating with the flaccid container for drawing discharged liquid and included dirt from the surface to be cleaned into the flaccid container under the influence of vacuum, so that the container fills with used liquid at a volume rate essentially equal to the rate of depletion of the unused liquid. The used or dirty liquid is disposed of by simply removing the top of the machine and dumping the liquid out. This procedure works fine for small machines of about five gallons. However, in large commercial and industrial cleaning machines, the reservoir usually contains twenty or thirty or more gallons (160–240 lb) and it is difficult or impossible to empty the machine by dumping. It would be impractical or impossible to lift the flaccid container from the machine when filled with spent dirty liquid because of its weight (approximately 160–240 lb) which, even if it could be done, would cause overstressing and damage to the flaccid container. In addition, the flaccid bag in U.S. Pat. No. 3,896,520 is smaller than the outer case which results in stress to the flaccid container as it fills with liquid. Repeated stressing will shorten the life of the flaccid container and can result in rupture of the flaccid container with unfavorable consequences, such as frequent and costly replacement of the flaccid container, the mixing of clean and used dirty solution, in turn, jamming and damaging the pump motor and costly repair and removal of debris with associated expensive down time in professional use of such equipment.

U.S. Pat. No. 4,196,492 discloses a carpet cleaning machine comprising a body which carries a storage means comprising a flexible bag for holding fresh cleaning solution which is received in an external rigid storage chamber. Spent dirty cleaning solution is collected in the external rigid storage chamber. The machine carries a scrubbing unit or means for cleaning the carpet. The scrubbing means includes a nozzle means for applying fresh cleaning solution to the carpet and a vacuum means for removing the spent cleaning solution from the carpet. The flexible bag of U.S. Pat. No. 4,196,492 is undersized and only partially supported by the walls of the external chamber when it is full resulting in severe localized stressing of the bag, shortening its life. This problem is also true of the alternate embodiment as well as U.S. Pat. No. 4,210,978 wherein the flexible bag is replaced by a plastic membrane.

In addition, while the flexible bag has a valve connection to the liquid spray system, it does not have a dump valve arrangement, additionally it is permanently mounted in place and cannot be removed for cleaning of the spent dirty solution rigid storage chamber without major dis-assembly of the whole unit. Even though the bag is filled with clean water, inevitably the interior of the bag becomes contaminated with minerals and other deposits, and the exterior storage chamber becomes contaminated by dirty water. With the flexible bag being permanently mounted to both the bottom spray head outlet and to the top part of the rigid tank body, it is inevitably subject to hazardous bacterial growth without the needed access for proper cleaning of the spent dirty solution tank which is exterior to the non-removable flexible bag.

U.S. Pat. No. 4,210,978 relates to a carpet cleaning machine comprising a body which carries a rigid storage chamber for holding fresh cleaning solution and a second storage chamber for receiving spent cleaning solution. A flexible membrane or partition divides an enclosed rigid cavity in the body into the first and second storage chambers. The flexible membrane is not supported and is simply permanently affixed (ref. page 12, line 30–35) at its extremities to the rigid cavity in the body such that there is severe stress when the second chamber is full of spent liquid. The membrane is not readily removable and inevitably becomes contaminated by the dirty spent cleaning liquid. This presents the same hazardous bacterial growth problem as the previously discussed U.S. Pat. No. 4,196,492. In addition it also does not have a dump valve connected directly to the flexible bag for easy vacating of the contained liquids.

Still further, U.S. Pat. No. 4,956,891 describes a floor cleaning machine comprising a support structure including a housing having a rigid water chamber, an inner spherical flexible container within the water chamber defining an inner chamber for retention of clean water. The machine of U.S. Pat. No. 4,956,891 does not provide any significant support for the spherical clean water chamber and thus stress is not prevented and eventual damage is inevitable. The spherical chamber is at the bottom permanently fixed to the spray head system outlet and at the top to the rigid tank body and thus is not adapted for ready removal from the machine. Therefore, the exterior of the flexible container and the return rigid waste tank surface becomes contaminated by dirty liquid and cannot be effectively cleaned without major disassembly of the whole unit, and thus will have the same hazardous bacterial growth problem as the previous discussed patents, U.S. Pat. Nos. 4,196,492 and 4,210,492. In addition it also does not have a dump valve connected directly to the flexible bag for easy vacating of the contained liquids.

None of the prior art devices is provided with means whereby a dump valve provides the emptying of both the flexible container and the rigid waste tank.

The present invention provides a novel cleaning machine in which the flexible flaccid container carries the dirty liquid and the dirty liquid can be easily removed by a dump valve in communication therewith. The bag is fully supported within the machine to avoid stress and provide long life. The flaccid container can be quickly disconnected and removed for easy cleaning. The machine of this invention is particularly adapted to large industrial and commercial machines of twenty, thirty or more gallons capacity. In the present invention, the flaccid container and the rigid waste tank can both be easily drained through a single dump valve.

SUMMARY OF INVENTION

Briefly, the present invention comprises a vacuum cleaner having:

a rigid vacuum-retaining outer case which is adapted to serve as a clean liquid reservoir, a flaccid container within said outer case serving as a holding reservoir for returned spent liquid, means for creating vacuum within said case in and around said flaccid container including an inlet communicating with said case, means communicating with said liquid reservoir for discharging liquid on a surface to be cleaned, and means communicating with said flaccid container for drawing said liquid and included dirt from said surface to be cleaned into said container under the influence of vacuum whereby said container can fill with used liquid at a volume rate essentially equal to the rate of depletion of the unused liquid; the improvement comprising valve means with said container to provide drainage of the container while it is within said outer case.

A floor cleaner having:

a rigid vacuum-retaining outer case the bottom of which is adapted to serve as a clean liquid reservoir, a flaccid container within said outer case serving as a reservoir for return spent liquid, means for creating vacuum within said outer case in and around said flaccid container including an inlet communicating with said outer case, means communicating with said liquid reservoir for discharging liquid on a surface to be cleaned, and means communicating with said flaccid container for drawing said liquid and included dirt from said surface to be cleaned into said container under the influence of vacuum whereby said container can fill with used liquid at a volume rate essentially equal to the rate of depletion of the unused liquid; the improvement comprising valve means whereby both said flaccid container and said rigid vacuum-retaining outer case can be drained while said flaccid container is within said outer case.

Further, this invention comprises a floor cleaner having:

a rigid vacuum-retaining outer case which is adapted to serve as a clean liquid reservoir, a flaccid container within said outer case serving as a holding reservoir for returned spent liquid, means for creating vacuum within said case in and around said flaccid container including an inlet communicating with said case, means communicating with said liquid reservoir for discharging liquid on a surface to be cleaned, and means communicating with said flaccid container for drawing said liquid and included dirt from said surface to be cleaned into said container under the influence of vacuum whereby said container can fill with used liquid at a volume rate essentially equal to the rate of depletion of the unused liquid; the improvement comprising means for quick disconnecting said flaccid container from the balance of the vacuum cleaner to permit the flaccid container when essentially empty to be lifted from the vacuum cleaner to permit the rigid outer container and the flaccid inner container to be easily cleaned to avoid the health hazard of germicidal build-up.

In another important embodiment, this invention comprises a floor cleaner having:

a rigid vacuum-retaining outer case which is adapted to serve as a clean liquid reservoir, a flaccid container within said outer case serving as a holding reservoir for returned spent liquid, means for creating vacuum within said case in and around said flaccid container including an inlet communicating with said case, means communicating with said liquid reservoir for discharging liquid on a surface to be cleaned, and means communicating with said flaccid container for drawing said liquid and included dirt from said surface to be cleaned into said container under the influence of vacuum whereby said container can fill with used liquid at a volume rate essentially equal to the rate of depletion of the unused liquid; the improvement comprising said flaccid container being oversize with respect to the outer case, such that as the container fills with liquid it is extensively supported and maintained in a minimally stressed state by bearing fully against the outer case surface.

THE DRAWINGS

Turning to the drawings.

Figure 1:
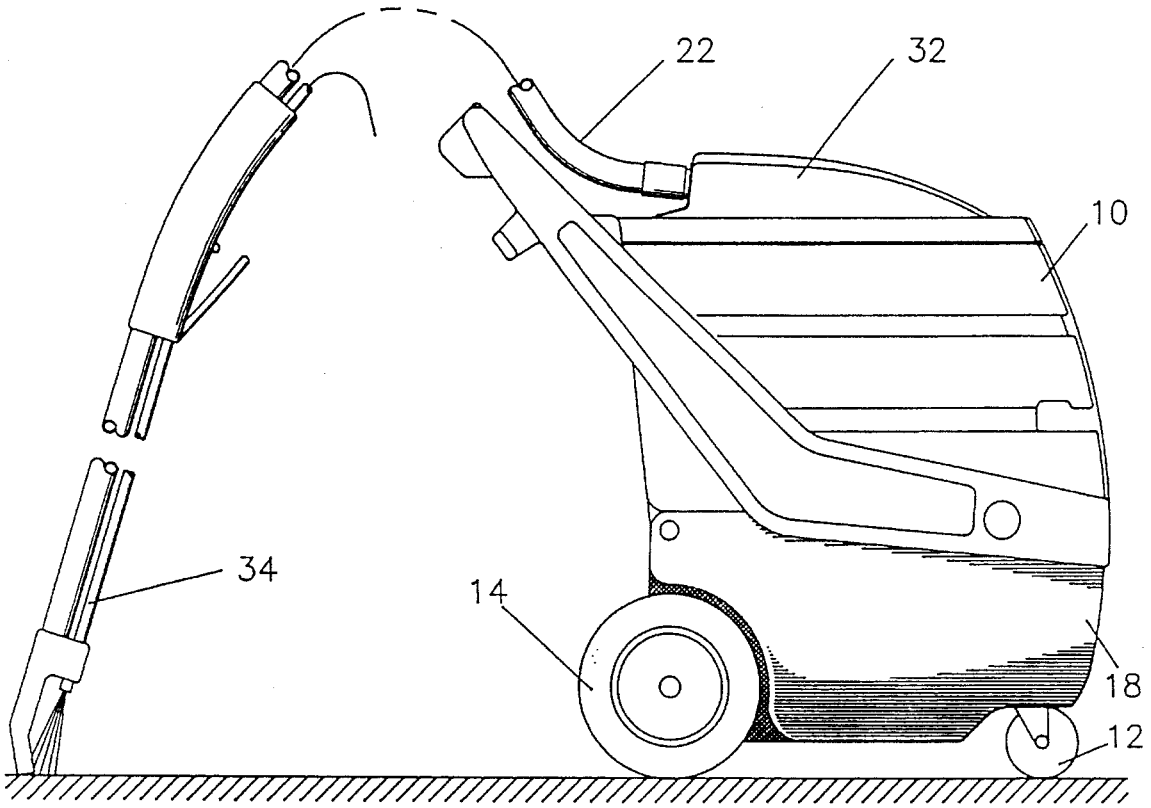
FIG. 1 is a side plan view of the preferred embodiment of the invention.

Considering the drawings in greater detail, it is to be understood that the device has similarities to the vacuum cleaner of U.S. Pat. No. 3,896,520, the disclosure of which is incorporated by reference.

THE DESCRIPTION OF PREFERRED EMBODIMENTS

The significant points of novelty are emphasized hereinbelow.

The body of the machine is provided with front and rear wheels 12 and 14, respectively. The vacuum motor 16 within outer machine housing 18 maintains a vacuum within rigid vacuum-retaining case 10 and around the flaccid container 20. The spent dirty water is sucked up via line 22 and through defuser/separator 24 into flaccid container 20.

Figure 4:
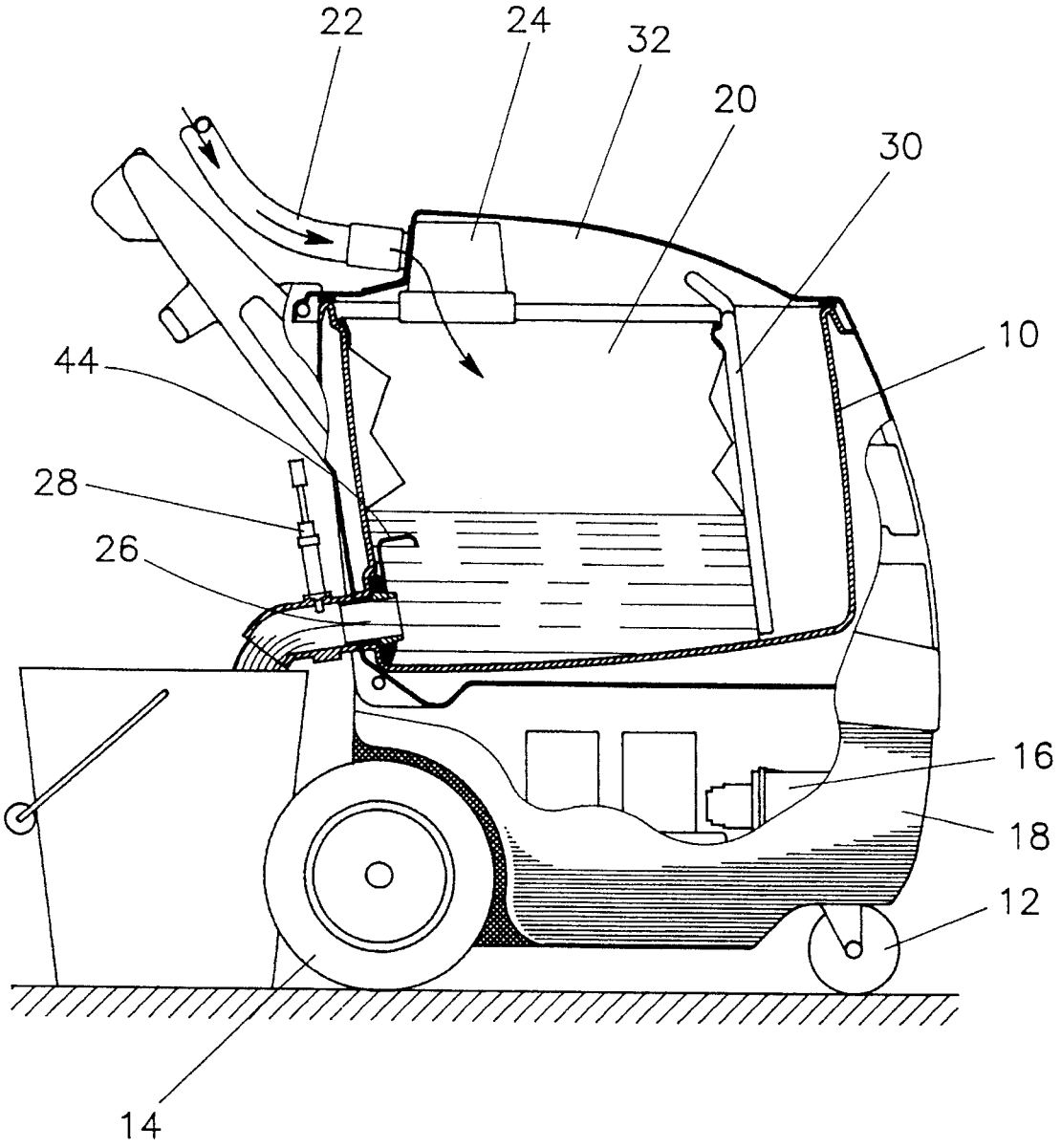
FIG. 4 shows the machine of FIG. 1 with the flaccid container fully supported by the rigid outer container and all of the cleaning liquid being dirty and being discharged from the machine via the dump valve.

The flaccid container 20 can be emptied of dirty liquid via line 26 which communicates with dump valve 28, FIG. 4.

The flaccid container 20 is oversize with respect to container 18 in the space further defined by baffle 30 so that the container is well supported on its bottom and at its sides as best shown in FIG. 4.

When the flaccid container expands during the filling mode, it expands to the outer rigid wall of the solution container since the flaccid container is slightly larger than the container it is in and it expands fully to the outer supporting wall and thus avoids pressure/stress from the filling liquids. These pressures are transmitted to the water rigid walls thereby protecting the flaccid/flexible vinyl (such as PVC) bag from damage such as will occur in the above mentioned prior art patents.

Figure 2:
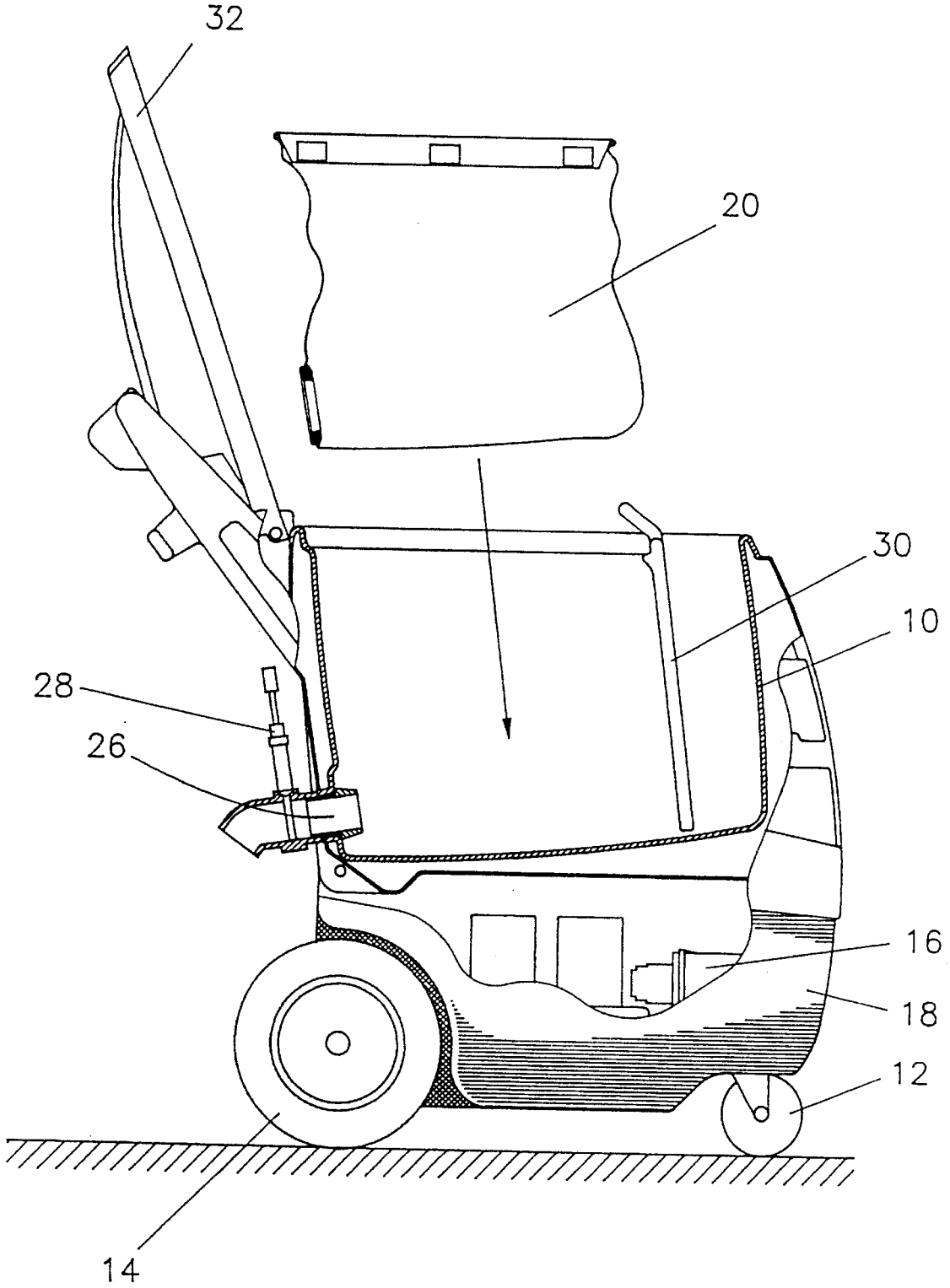
FIG. 2 shows the floor cleaner of FIG. 1 in partial breakaway with the flaccid container being shown lifted up and out of the machine.
Figure 3:
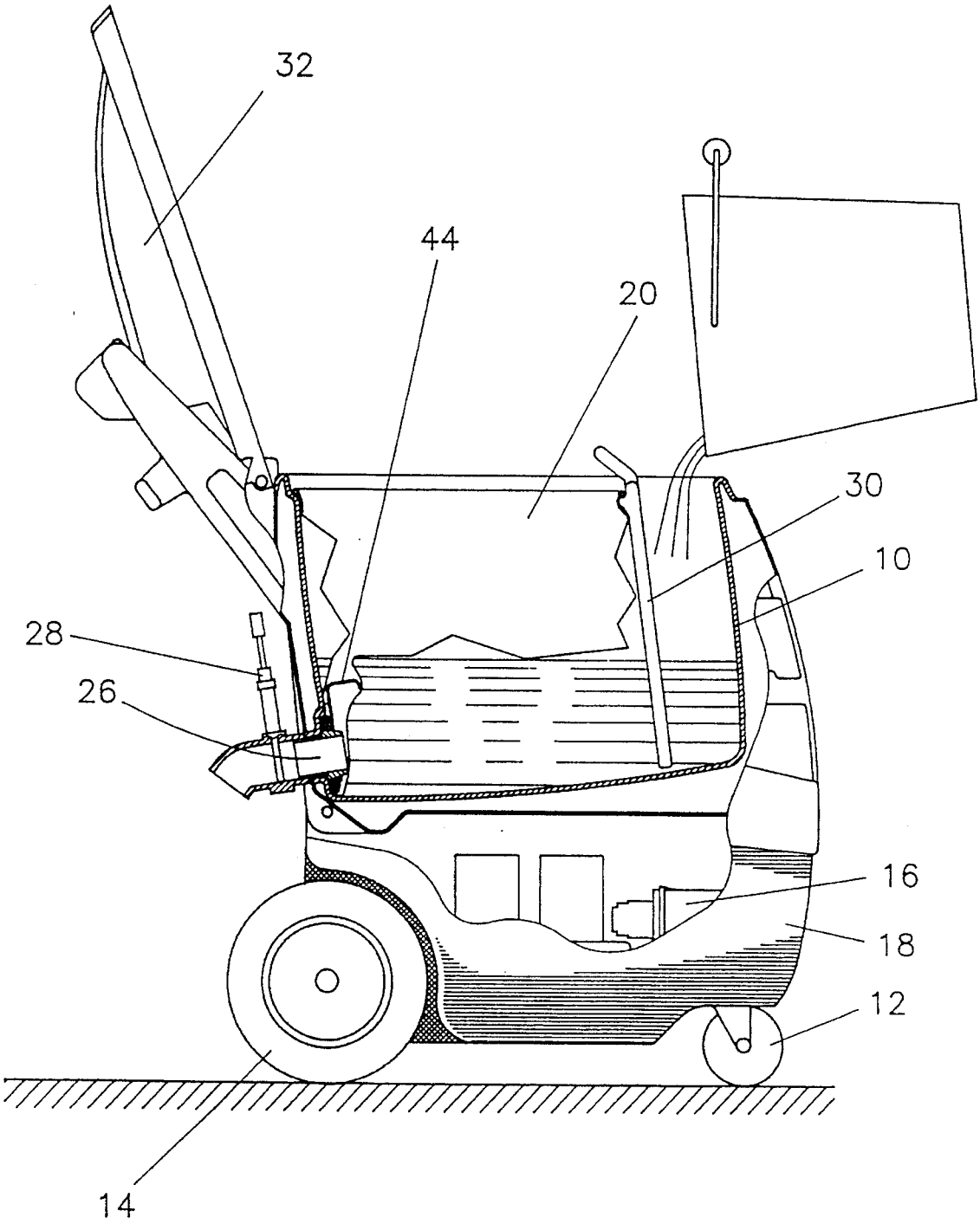
FIG. 3 shows the machine of FIG. 1 with the flaccid container in place and empty, and clean liquid being added to the rigid vacuum retaining outer case.
Figure 6:
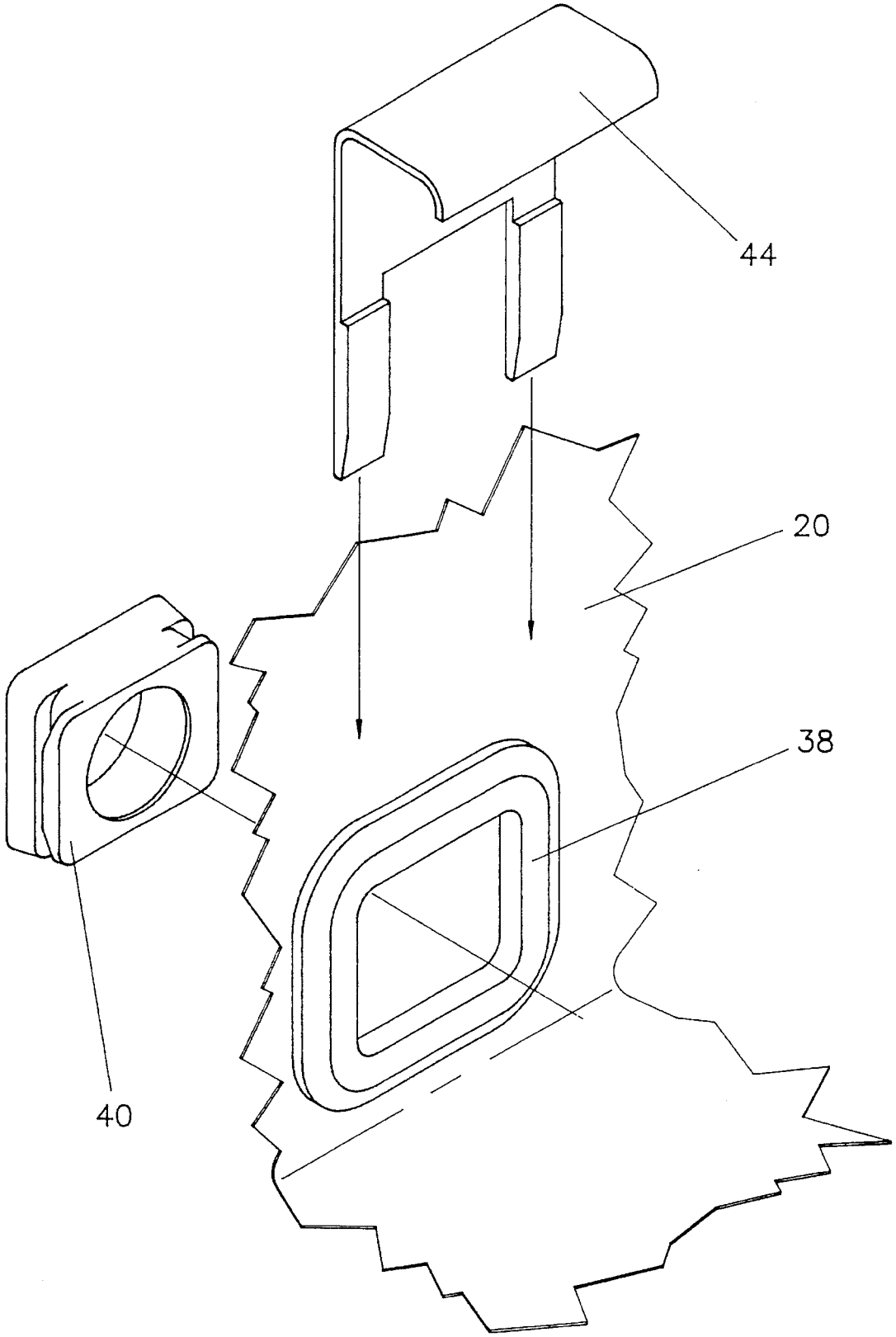
FIG. 6 is an enlarged exploded view of the connect-disconnect feature of FIG. 5.

The flaccid container 20 can be taken out for cleaning by lifting away the lid 32, quickly disconnecting the dump valve as shown in FIG. 6, and removing container 20, as shown in FIG. 2.

The fresh cleaning liquid is sprayed onto the surface to be cleaned via line 34.

Figure 5:
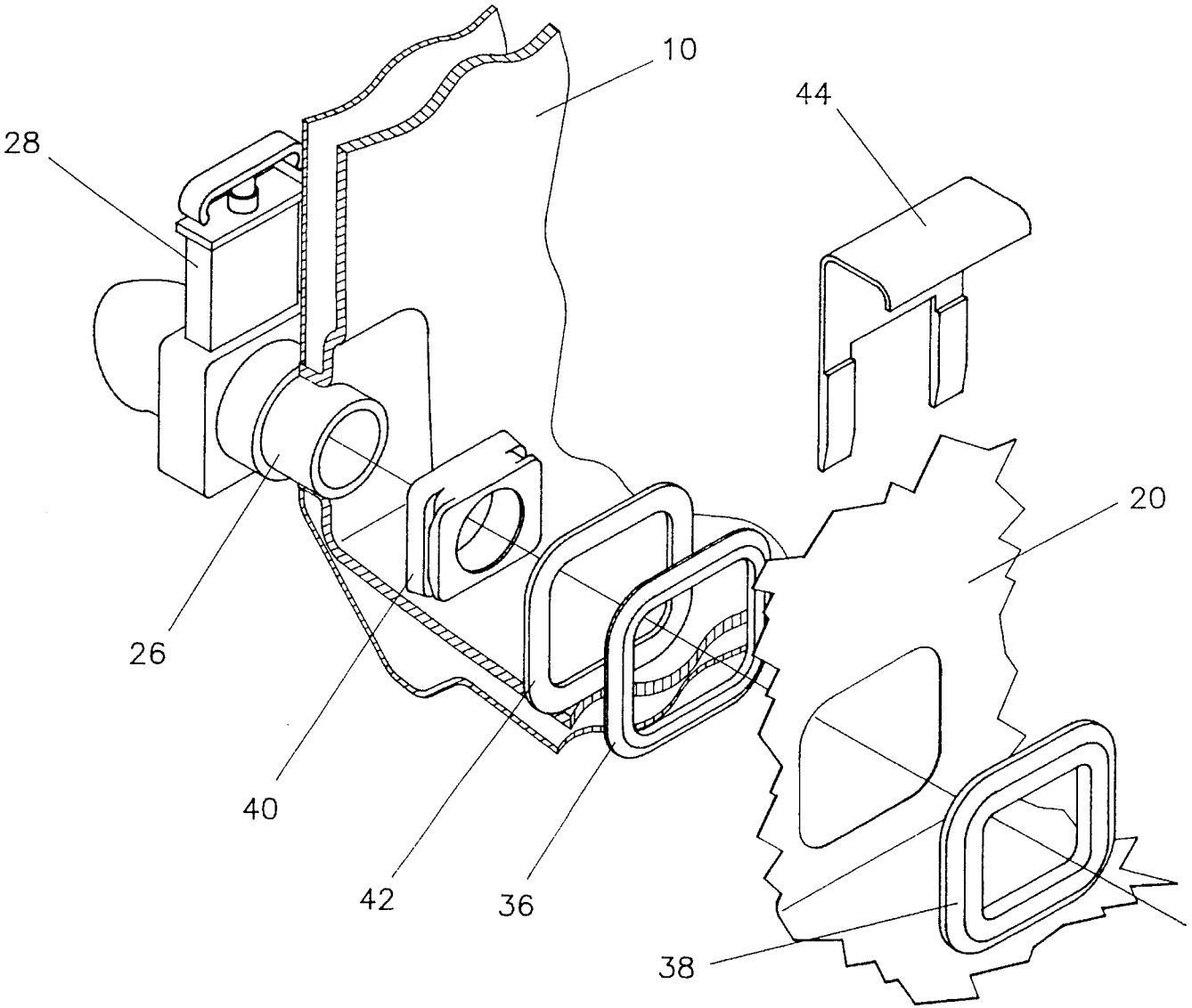
FIG. 5 is an enlarged exploded view of the connection elements between the dump valve and the flaccid dirty liquid container.
Figure 7:
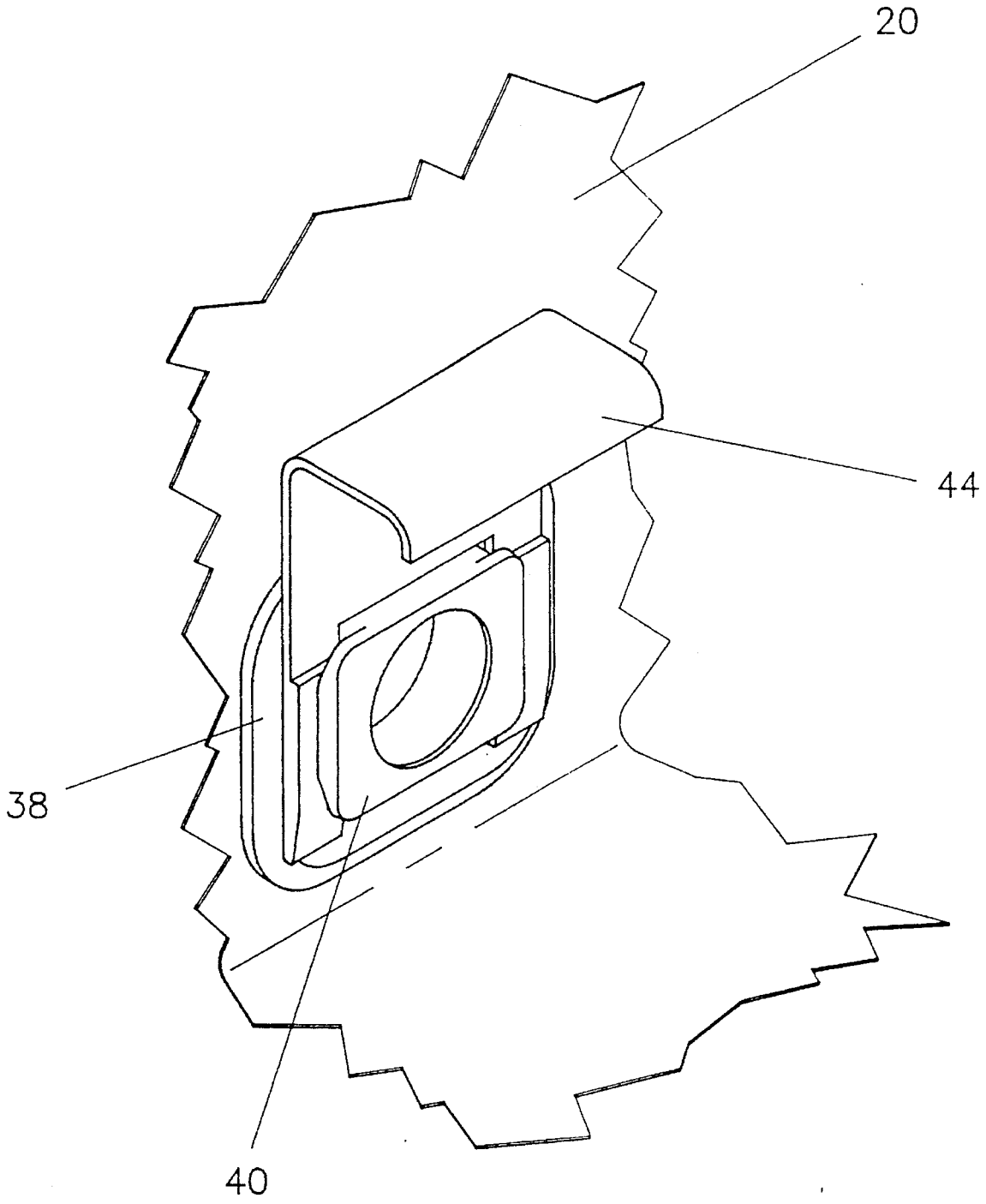
FIG. 7 shows the elements of FIG. 6 after being connected so that the dump valve is in fluid communication with the interior of the flaccid dirty liquid container.

Turning to FIGS. 5 to 7, the dump valve 28 and line 26 pass through and are permanently joined to the outer rigid container body 10. The flaccid bag 20 has adhered to opposing sides thereof rigid rings 36 and 38. The slotted retainer 40 slips over line 26 as do gasket 42 and rings 36 and 38. The slotted retainer 40 when in the fully assembled state (FIG. 7) protrudes slightly into flaccid container 20. The slide down holding fork 44 is then slid into place over retainer 40 to hold the flaccid container 20 in place. To remove flaccid container, fork 44 is simply pulled up, the flaccid container will fall away from line 26 and the flaccid container can be lifted out and removed from the machine for cleaning and disinfecting.

The flaccid container 20 is normally first emptied (FIG. 4), prior to removal.

By providing for easy lift out of the empty flaccid container and direct access for easy cleaning and maintenance of both the rigid outer container and the flaccid inner container, germicidal growth and build-up, and the resulting bad smell and health hazards are completely avoided, solving a serious problem in this art.

The dump or drain valve connects and/or quickly disconnects. The version shown is one of many possibilities and is not limited to that specific configuration. It serves to establish the connect and/or quick disconnect principle to a flaccid inner container. It is also important to note that both the flaccid inner container and the outer case can be drained via the dump valve. This can be done in several ways. For example, the flaccid container can be drained with the fork 44 in place. Then the fork 44 can be pulled and the unused contents of case 10 can be drained. Alternatively, the fork 44 can be pulled first, which allows mixing of the contents of the flaccid inner container with the contents of case 10. The mixed liquids are then drained via the dump valve. This is important because it is desirable in many instances to completely drain the machine of both spent and unspent liquid for purposes of cleaning and sanitation prior to storage.

Having fully described the invention, it is intended that it be limited only by the lawful scope of the appended claims.

I claim:

1. A floor cleaner having:

a rigid vacuum-retaining case having a bottom portion which is adapted to serve as a clean liquid reservoir, a flaccid container within said rigid vacuum retaining case serving as a reservoir for return spent liquid, means for creating vacuum within said rigid vacuum retaining case in and around said flaccid container including an inlet communicating with said outer case, means communicating with said liquid reservoir for discharging liquid on a surface to be cleaned, and means communicating with said flaccid container for drawing said liquid and included dirt from said surface to be cleaned into said flaccid container under the influence of vacuum whereby said flaccid container is adapted to be filled with spent liquid at a volume rate essentially equal to the rate of depletion of the clean liquid; the improvement comprising valve means being permanently joined to the rigid vacuum retaining case and communicating with said flaccid container to provide drainage of the flaccid container through the valve means while the flaccid container is within said outer case.

2. A floor cleaner having:

a rigid vacuum-retaining case having a bottom portion which is adapted to serve as a clean liquid reservoir, a flaccid container within said rigid vacuum retaining case serving as a reservoir for return spent liquid, means for creating vacuum within said rigid vacuum retaining case in and around said flaccid container including an inlet communicating with said outer case, means communicating with said liquid reservoir for discharging liquid on a surface to be cleaned, and means communicating with said flaccid container for drawing said liquid and included dirt from said surface to be cleaned into said flaccid container under the influence of vacuum whereby said flaccid container is adapted to be filled with liquid at a volume rate essentially equal to the rate of depletion of the clean liquid; the improvement comprising valve means being permanently joined to the rigid vacuum retaining case, both said flaccid container and said rigid vacuum-retaining case being adapted to be drained through said valve while said flaccid container is within said outer case.

3. The floor cleaner of claim 2, the improvement further comprising means for quick disconnecting said flaccid container from the vacuum floor cleaner to permit the flaccid container when essentially empty to be lifted from the vacuum cleaner to permit the flaccid container and the rigid vacuum retaining case to be cleaned or disinfected.

4. The floor cleaner of claim 3, the improvement further comprising said flaccid container being oversize with respect to the rigid vacuum retaining case, such that as the flaccid container fills with liquid the flaccid container is extensively supported and maintained in a minimally stress state by fully bearing against the rigid vacuum retaining case.

* * * * *